US007273149B2

(12) United States Patent
Lutes et al.

(10) Patent No.: US 7,273,149 B2
(45) Date of Patent: Sep. 25, 2007

(54) POINT OF PURCHASE DISPLAY CASE

(75) Inventors: Craig A. Lutes, Stevenson Ranch, CA (US); Ernesto Lopez, Whittier, CA (US)

(73) Assignee: Origin, LLC, Burbank, CA (US)

( * ) Notice: Subject to any disclaimer, the term of this patent is extended or adjusted under 35 U.S.C. 154(b) by 0 days.

(21) Appl. No.: 11/352,039

(22) Filed: Feb. 9, 2006

(65) Prior Publication Data

US 2006/0260979 A1 Nov. 23, 2006

Related U.S. Application Data

(60) Provisional application No. 60/682,080, filed on May 18, 2005.

(51) Int. Cl.
*B65D 5/52* (2006.01)

(52) U.S. Cl. ..... 206/768; 206/736; 206/767

(58) Field of Classification Search ..... 206/768, 206/736, 767, 45.8, 743, 744, 745, 42.5, 206/758, 774; 211/1, 134, 135, 186, 149, 211/189, 195, 196; 220/8; 229/103
See application file for complete search history.

(56) References Cited

U.S. PATENT DOCUMENTS 1,949,376 A * 2/1934 Mansfield et al. ..... 206/765
2,571,301 A * 10/1951 Slanhoff ..... 211/135
3,567,014 A 3/1971 Feigelman
3,656,611 A 4/1972 Mertz
3,692,174 A 9/1972 Ross
3,755,944 A 9/1973 Kaulfuss et al.
3,757,934 A 9/1973 Taub
3,799,332 A 3/1974 Jeronimus
3,918,576 A 11/1975 Taub
4,148,427 A 4/1979 Baker
4,164,287 A 8/1979 Muller et al.
4,191,288 A 3/1980 Hostad
4,274,613 A 6/1981 Taub (Continued)

FOREIGN PATENT DOCUMENTS

CA 2306358 10/2000

(Continued)

OTHER PUBLICATIONS

Applicants' photographs of prior art display case.

*Primary Examiner*—Mickey Yu
*Assistant Examiner*—Steven A. Reynolds
(74) *Attorney, Agent, or Firm*—Christie, Parker & Hale, LLP

(57) ABSTRACT

A cardboard display case for DVDs and the like has a box-like case of folded cardboard with a plurality of shelves on three sides for displaying goods. A retractable pop-up display header extends above the top face of the case near the back. There is a hollow inside the case so that the header can be retracted within the case for shipping. When at a retail store, for example, the header is pulled up to display graphics above the top of the case. A folded cardboard member within the case has a retractable shelf supporting the header when extended above the case. The shelf is folded out of the way when the header is retracted within the case.

35 Claims, 9 Drawing Sheets

U.S. PATENT DOCUMENTS

| | | | | |
|---|---|---|---|---|
| 4,382,504 | A | 5/1983 | Vesborg | |
| 4,384,651 | A | 5/1983 | Smith | |
| 4,519,319 | A | 5/1985 | Howlett | |
| 4,567,981 | A | 2/1986 | Headon | |
| 4,579,220 | A | 4/1986 | Brundage | |
| 4,611,866 | A | 9/1986 | Everett | |
| 4,784,277 | A | 11/1988 | Wallish et al. | |
| 4,809,847 | A | 3/1989 | Schneider | |
| 4,813,536 | A | 3/1989 | Willis | |
| 4,919,270 | A | 4/1990 | Govang et al. | |
| 4,938,343 | A | 7/1990 | Willis | |
| 4,947,985 | A | 8/1990 | Crabtree et al. | |
| 5,016,545 | A | 5/1991 | Robertson et al. | |
| 5,042,651 | A | 8/1991 | Davis et al. | |
| 5,251,753 | A | 10/1993 | Pigott et al. | |
| 5,259,578 | A | 11/1993 | Jones et al. | |
| 5,513,745 | A | 5/1996 | Zoltan et al. | |
| 5,540,335 | A | 7/1996 | Friedman | |
| 5,547,073 | A | 8/1996 | Smith | |
| 5,630,518 | A | 5/1997 | Collins | |
| 5,697,505 | A | 12/1997 | Sprague | |
| 5,706,597 | A | 1/1998 | Brandstetter | |
| 5,762,203 | A | 6/1998 | Klawiter et al. | |
| 5,896,995 | A | 4/1999 | Murray et al. | |
| 5,899,345 | A | 5/1999 | Fuller et al. | |
| 6,038,797 | A | 3/2000 | Smith | |
| 6,098,820 | A | 8/2000 | Smith | |
| 6,158,579 | A | 12/2000 | Rosenbaum | |
| 6,267,255 | B1 | 7/2001 | Brush | |
| 6,293,405 | B1 | 9/2001 | Burch, Jr. | |
| 6,386,371 | B1 | 5/2002 | Parsons | |
| 6,394,290 | B1 * | 5/2002 | Walsh et al. | 211/149 |
| 6,454,107 | B1 | 9/2002 | Belanger et al. | |
| 6,488,245 | B1 | 12/2002 | Maglione | |
| 6,837,378 | B2 | 1/2005 | Mason et al. | |
| 6,837,379 | B2 | 1/2005 | Dennis et al. | |
| 6,886,737 | B2 | 5/2005 | Dye | |
| 6,892,876 | B1 * | 5/2005 | Aubry et al. | 206/232 |
| 6,929,133 | B1 | 8/2005 | Knapp, III et al. | |
| 6,942,113 | B1 | 9/2005 | Johnske et al. | |
| 2003/0192809 | A1 * | 10/2003 | Bucknell | 206/774 |
| 2004/0011753 | A1 * | 1/2004 | Field et al. | 211/132.1 |

FOREIGN PATENT DOCUMENTS

| | | | |
|---|---|---|---|
| DE | 3411491 | A1 | 10/1985 |
| GB | 2351432 | A | 1/2001 |

* cited by examiner

POINT OF PURCHASE DISPLAY CASE

CROSS-REFERENCE TO RELATED APPLICATION(S)

This application claims priority benefit of the filing date of U.S. Provisional Patent Application 60/682,080, filed May 18, 2005.

BACKGROUND

This invention concerns a corrugated cardboard display case which may be placed in an aisle of a department store, or the like, to hold packaged DVDs, CDs, vitamin supplements, packaged food items, consumer packaged goods, toys or the like, for prospective customers to simply lift the goods from the case to drop into their shopping basket. Such a point of purchase display case may be set on a multi-size pallet for easy placement in the store. The display case is like a large box, about four feet high, four feet wide and two feet thick, a size referred to as a "half cube". This may also be used for quarter cube, ⅛ cube, full cube sizes. Half cube size is used solely for this description.

Such display cases are delivered to the store where they will be used as a box-like case with no protrusions. After unwrapping at the store, a display header is usually mounted across the back of the display case. This header may have advertising graphics and a place to insert pricing information or the like. In a prior display case, one or more holes are provided through the top of the case and a display header has poles or posts that are dropped through the holes to support the header. Such headers may be provided with the display case as separate pieces to be installed after delivery to the store, or they may be provided by the store itself. Either way, they are attached after the case is on the floor. This causes problems. Sales associates may sometimes forget to install the header or the separate pieces may become separated so that they are not properly mounted.

In accordance with this invention, a "pop-up" display header is built into the display case so that it cannot be separated from the case before it is installed in the store. All that is needed is for a person to pull the header up from within the case. There are stops to keep the header from being pulled up too far and to prevent its dropping back into the case.

BRIEF SUMMARY OF THE INVENTION

A display case with a pop-up display header movable between a retracted position within the display case and an extended position outside the display case. Means are provided for supporting the header in its extended position.

DESCRIPTION

A presently preferred point of purchase display case is somewhat like a large rectangular cardboard box. When used as an in-store display, it includes an open, generally U-shaped volume across the front and two end faces, each of which has shelves on which prepackaged goods 11 are placed for display and sale. For example, DVDs or CDs may be placed on the shelves to be picked up by customers and put in their shopping carts. This much of the case is conventional. The construction of the case is also conventional, using folding, tabs, inserts, etc., well recognized by those skilled in the art. Such techniques are sufficiently well known that the case can be assemble entirely without glue or fasteners, however, if desired, glue or fasteners can be used in this or other case configurations.

Other configurations of display case may be used, such as different shelf and display arrangements, for example, to accommodate different goods. Although described for a half cube display case, a full cube or pallet size may also be used. The movable display header is shown at the back of the display case. If desired, the header may be movable up and down near the center of the display case, a configuration that may be preferred for a full cube display case since products could be placed on all four faces of the case. The half cube case is preferable since more flexible for use by the retail merchant, and two such cases can be put back-to-back if a full cube configuration is desired.

In the half-cube size, the header may also be placed nearer the center of the case instead of adjacent to the back face. In many embodiments there is an ample hollow behind the shelves supporting displayed goods to receive the pop-up header when retracted, even when it is more remote from the back face of the case. In such an embodiment, the header may be right behind the back of the space in which goods are displayed and means for supporting the pop-up header in its extended and retracted positions can be integral with or attached to the back of the display shelf portion.

The case and a portion of the display header 10 on the case of this invention have advertising graphics (which are not shown). The front face of the header may include plastic extrusion strips 12 for holding pricing information or the like. Pricing information is typically installed after the case reaches the store and the header is erected.

Figure 8:
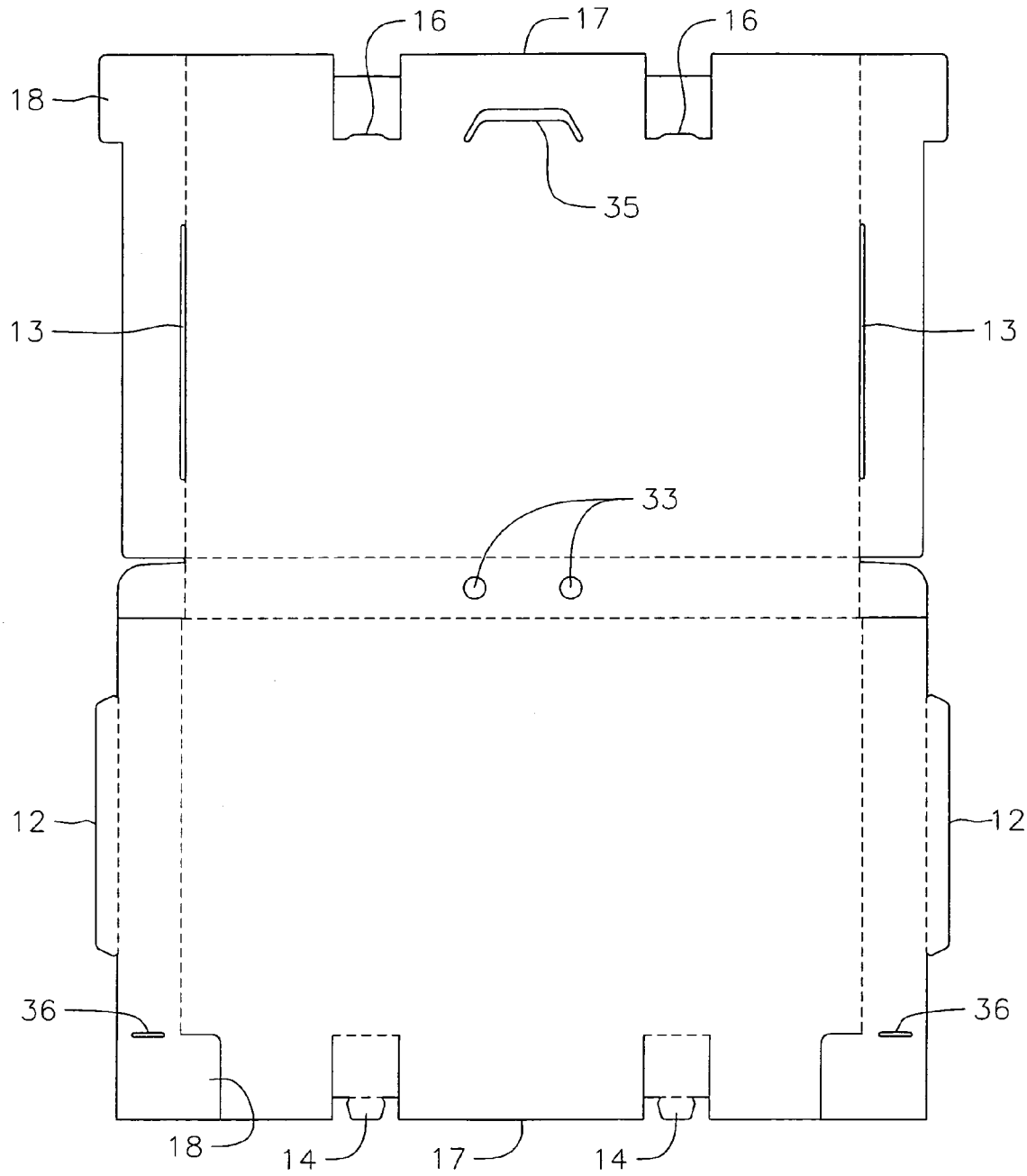
FIG. 8 is a view of the flat cardboard from which the display header is folded in the center. Cuts are shown in solid line and folds are shown in dashed lines.

The header is folded into a hollow box-like form from the flat sheet illustrated in FIG. 8, with tabs 12 on one side inserted through slots 13 adjacent the opposite face. That is, tabs near the front face are inserted into slots near the back face after the sheet is folded along the fold lines 15. Smaller tabs 14 folded from adjacent the front face are pushed through corresponding slots 16 on the back face of the header to complete locking the header into a rectangular box-like form.

Instead of a hollow box-like header, multiple thicknesses of cardboard may be used to provide adequate stiffness for the header.

Extensions 17 extend downwardly in the central portion of the header for determining the position of the header in its DOWN position and stabilizing the header in its UP position. In an exemplary embodiment, the folded header is like a closed box about three inches thick, 32 inches wide and 20 inches high (plus the extensions 17). These and other dimensions are nominal or exemplary sizes for purposes of this description.

Figure 5:
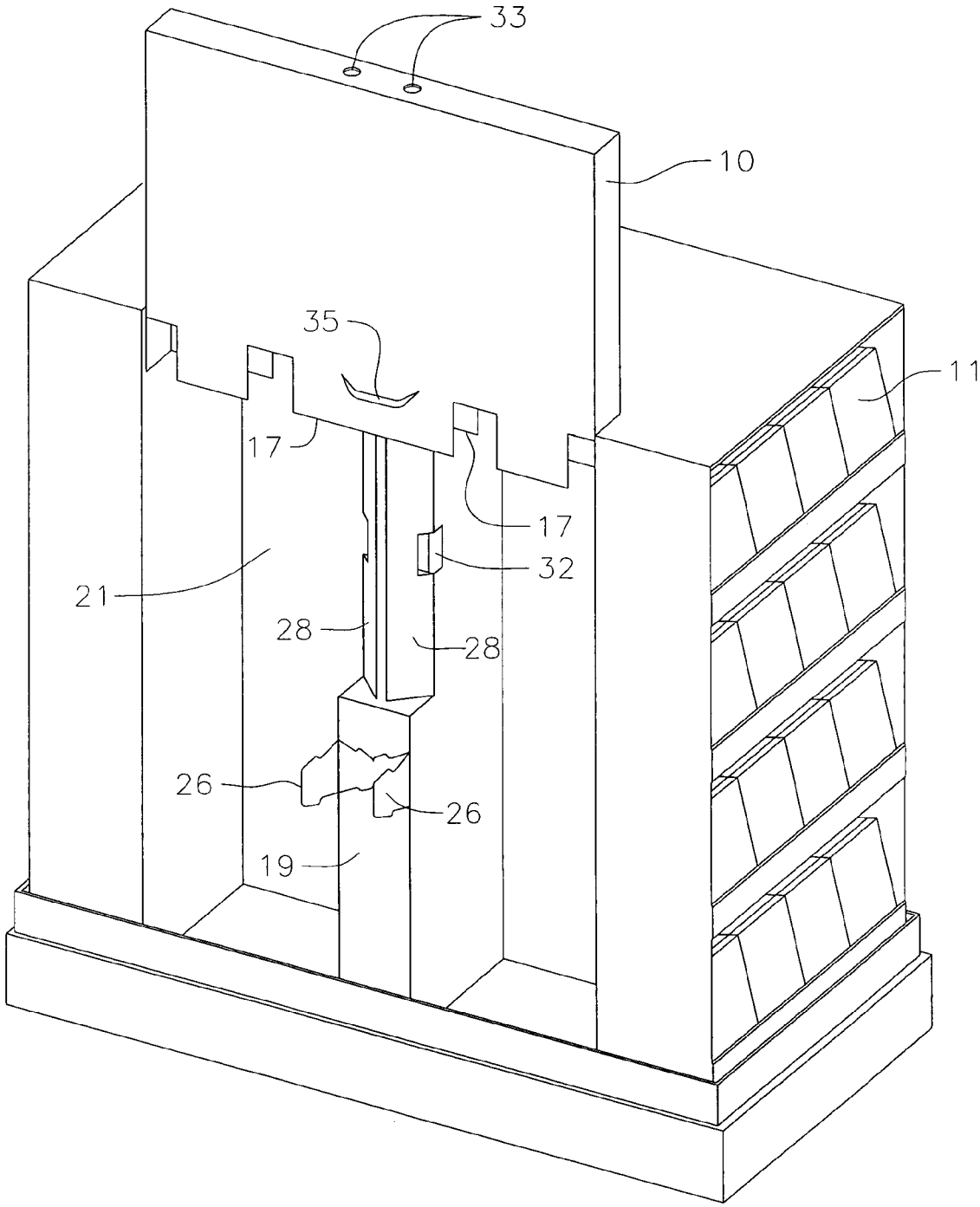
FIG. 5 is another view of the back of the case with the cardboard back panel removed. In this view the pop-up display header is in its elevated position.

Each side or end face 20 of the header is generally L-shaped with a step 18 extending in the forward direction near the lower end of the header. When the header is raised to its UP position (such as illustrated in FIG. 5) the step engages the top of the case on the inside and inhibits the header from being elevated further.

Figure 4:
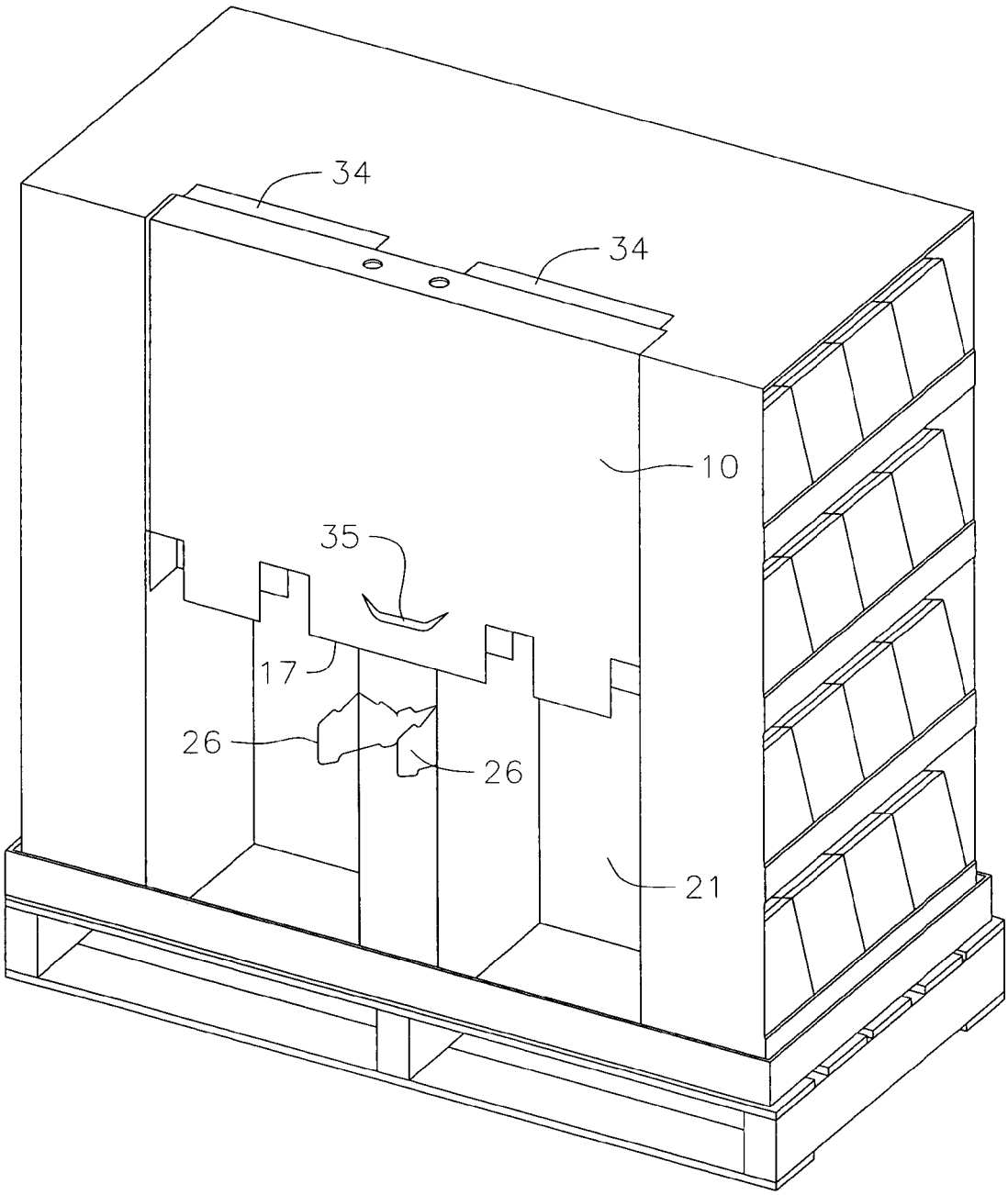
FIG. 4 is a similar view of the back of the case with the outer back cardboard panel removed so that the retracted header can be seen.

A central "column" 19 (e.g. in FIGS. 4 and 5) is inside the case in a hollow behind the U-shaped volume within which goods are displayed. The column is effectively a hollow cardboard tube extending the full height of the case. In one embodiment, the column is about five inches wide and eleven to twelve inches front to back. The column is bent and assembled from a flat sheet as illustrated in FIG. 9.

Four tabs 22 on one edge of the flat blank are inserted through slots 23 near the opposite edge to lock the column in its rectangular shape. The column is secured inside the case by inserting tabs 24 through slots (not shown) in the flat inner back panel 21 inside the case (e.g. FIGS. 4 and 5) behind the goods being displayed. Each of the tabs passes through a first slot and is bent 90°. A second 90° bend is made in the tab and the broadly arrow-shaped end of the tab is passed through a second slot to lock the tab in place. This is a connection for cardboard, known in the trade as a beltlock. Another pair of similar tabs 26 are used to interconnect the column and outer back face of the display case.

Figure 9:
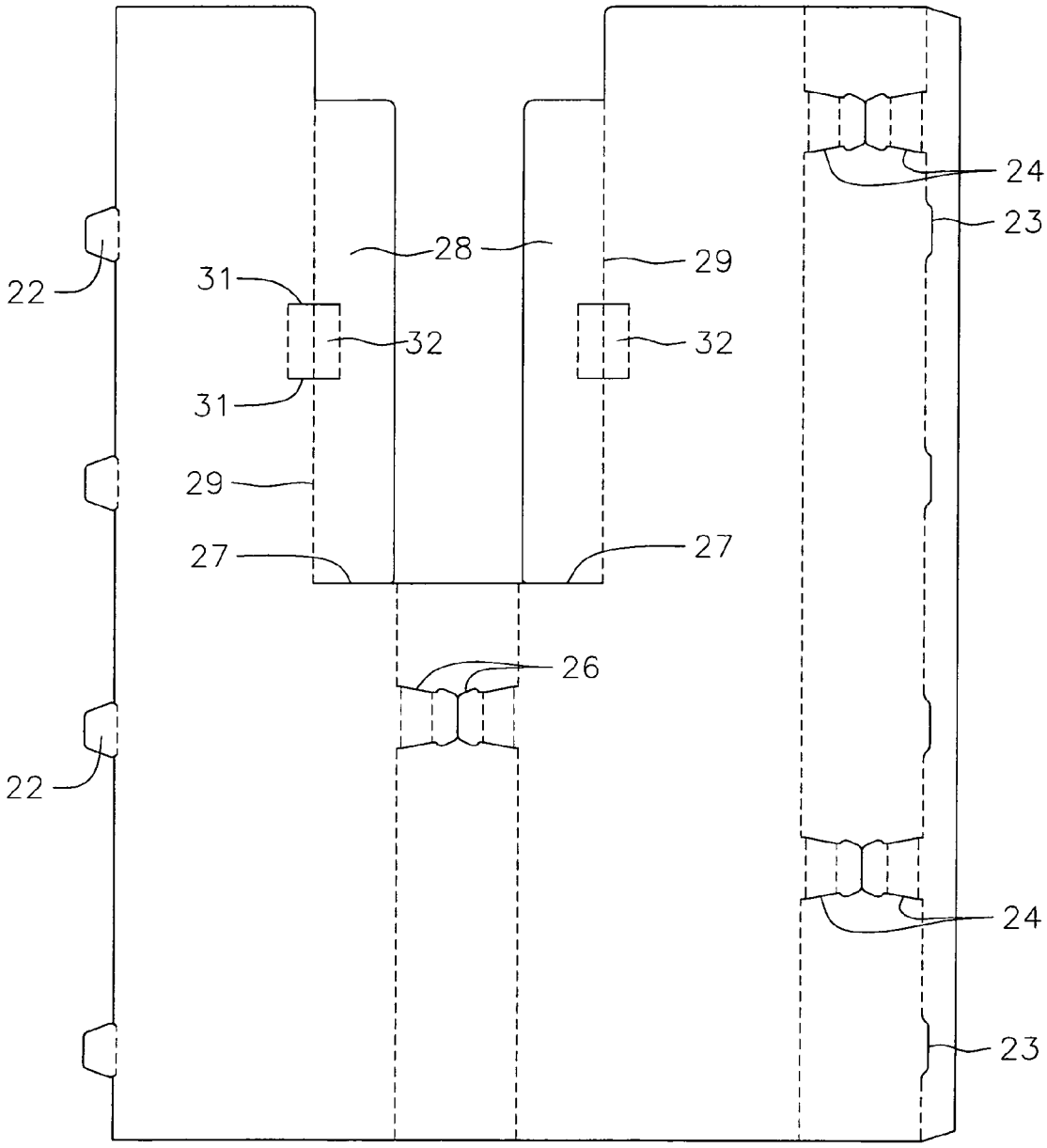
FIG. 9 is a view of the flat cardboard from which a "column" 19 is folded for installation inside the case.

Approximately half (the lower half when installed and as illustrated in FIG. 9) of the height of the column is an enclosed rectangular tube. This part ends as a step 27 which acts as a shelf or ledge. Above the step there are two wings or flaps 28 which extend upwardly from the step to within three or four inches from the top of the column and the top of the display case. A vertical fold line 29 between each wing and the side of the column, is bent about 45° or more so that the wings each lie roughly in a plane parallel to the back face of the display case when in a retracted position and extend in a general V-shape pointing toward the back face when extended. The flutes of the corrugated cardboard used to form the column are preferably aligned in a vertical direction to parallel the fold lines 29 of the wings.

Two horizontal cuts 31 are made across the long wing fold line 29. The resulting rectangle between the cuts is folded so that the center fold line 32 on the small rectangle is in the opposite direction from the longer wing fold line 29. The resulting reverse folded rectangle acts like a spring and along with the inherent memory of the cardboard urges the wings toward a position converging towards each other in a V-shape pointed toward the outer back face of the display case as illustrated in FIG. 5.

An exemplary grade of corrugated cardboard for the header and display case is B flute, 32 ETC (sometimes referred to as 200 pound). Different grades of cardboard may be used for different size cases or where heavier goods are to be displayed, for example. Different parts of the assembly may be made of different grades of cardboard. For example, the case and header may be made of different grades, or the shelves may be a different grade from the rest of the case.

Figure 3:
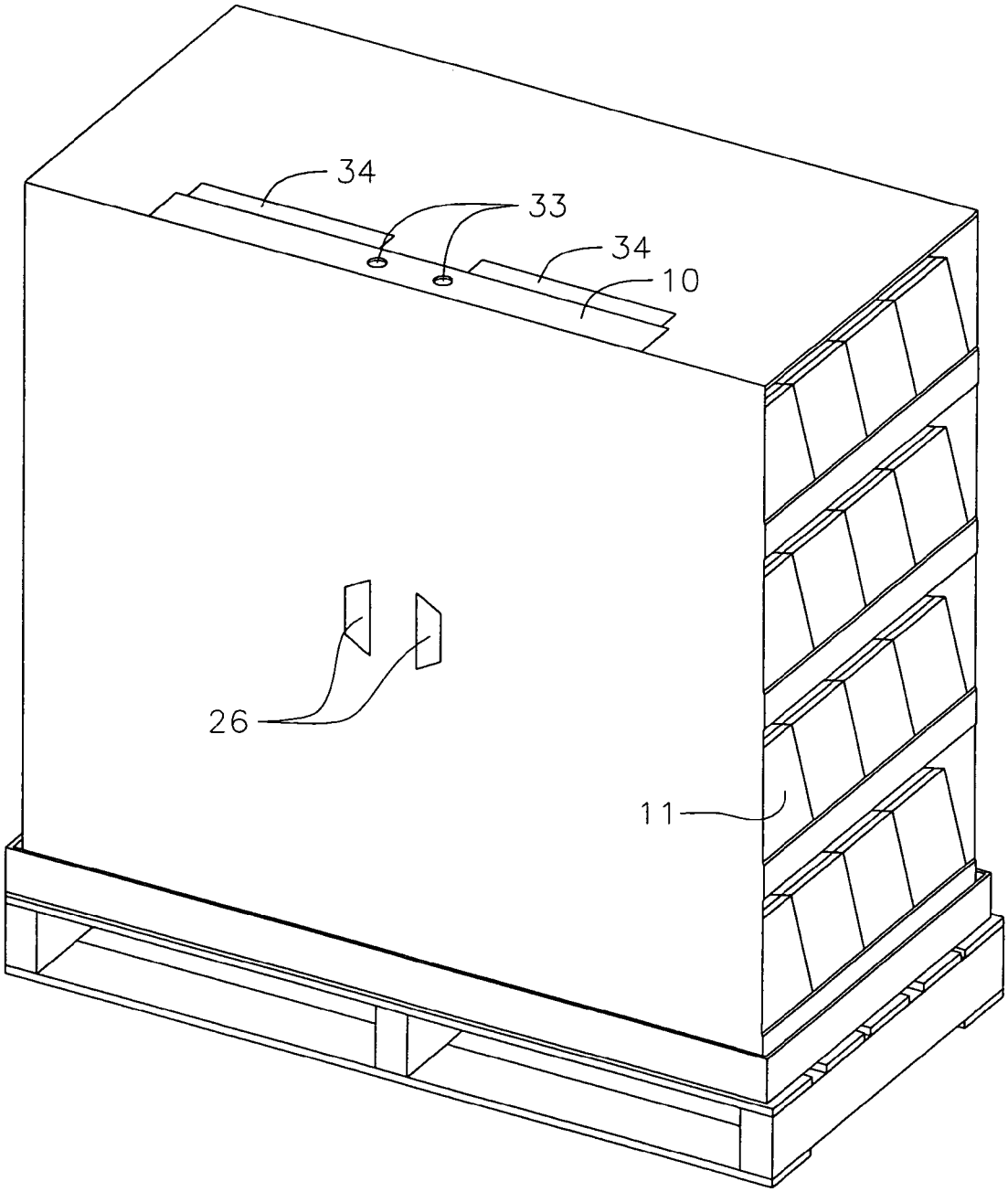
FIG. 3 is a similar view of the back of the display case with the header retracted inside the case, the position it occupies during shipping, for example.

When the header is in its DOWN or retracted position (FIG. 3) at least one of the central tabs 17 on the bottom of the header rests on the top of the step 27 of the column. This supports the display header to keep it from dropping further into the display case. When retracted or DOWN, the front face of the header holds the wings or flaps 28 roughly in the same plane as the inner back panel 21 inside the case.

When it is desired to move the header to its UP or extended position, the person setting up the display in the store simply sticks a finger and thumb into a pair of holes 43 in the top of the header and lifts the header upwardly. The header moves upwardly until stopped when the L-shaped steps 18 on the ends of the header engage the top of the display case (on the inside). As the header is moved upwardly, a couple flaps 34 in the top of the case fold upwardly temporarily to permit the display mounting strips 12 to pass.

Figure 6:
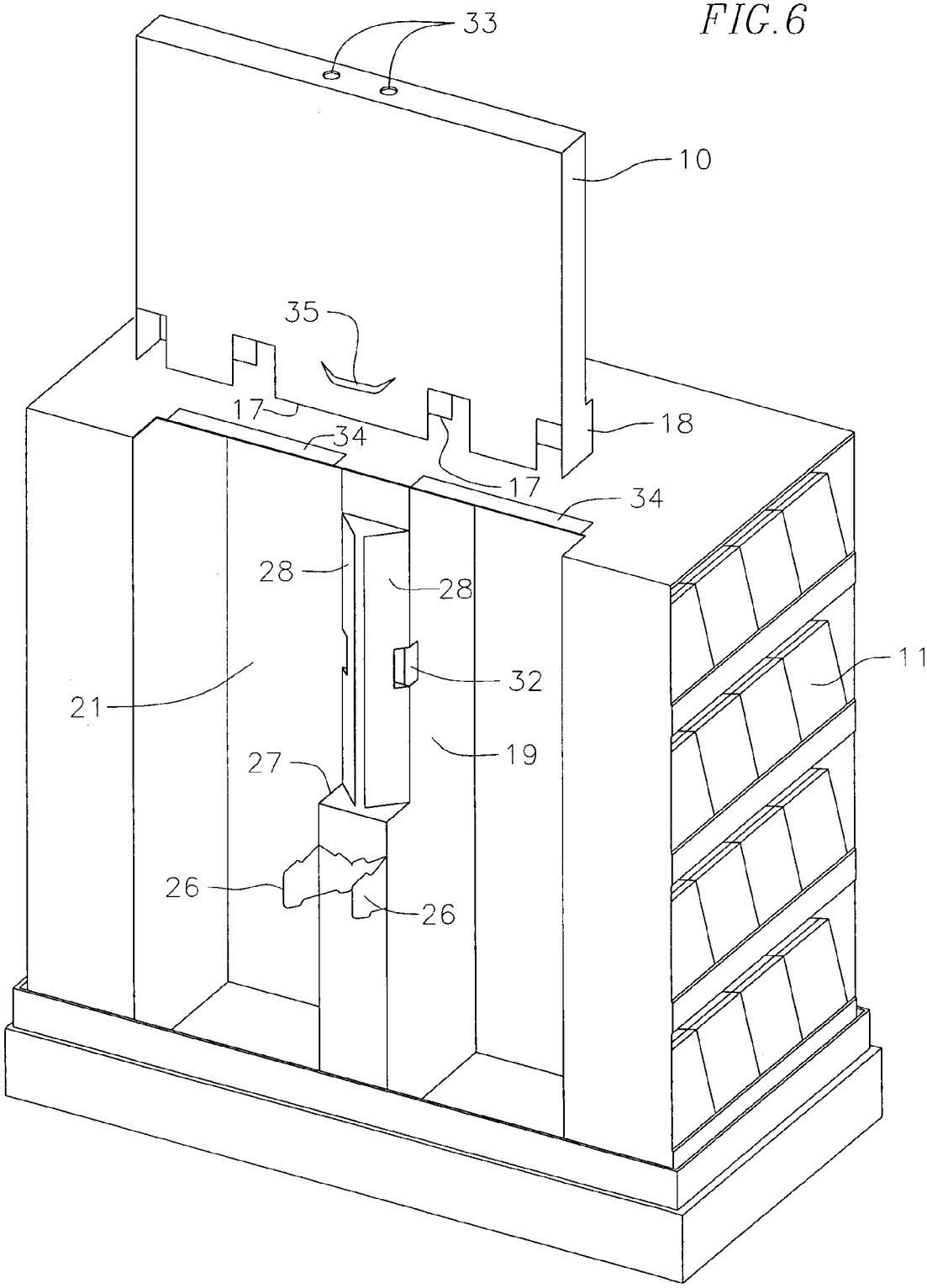
FIG. 6 is similar to FIG. 5, except that in this view the header is shown exploded from the display case to reveal details hidden in FIG. 5.
Figure 7:
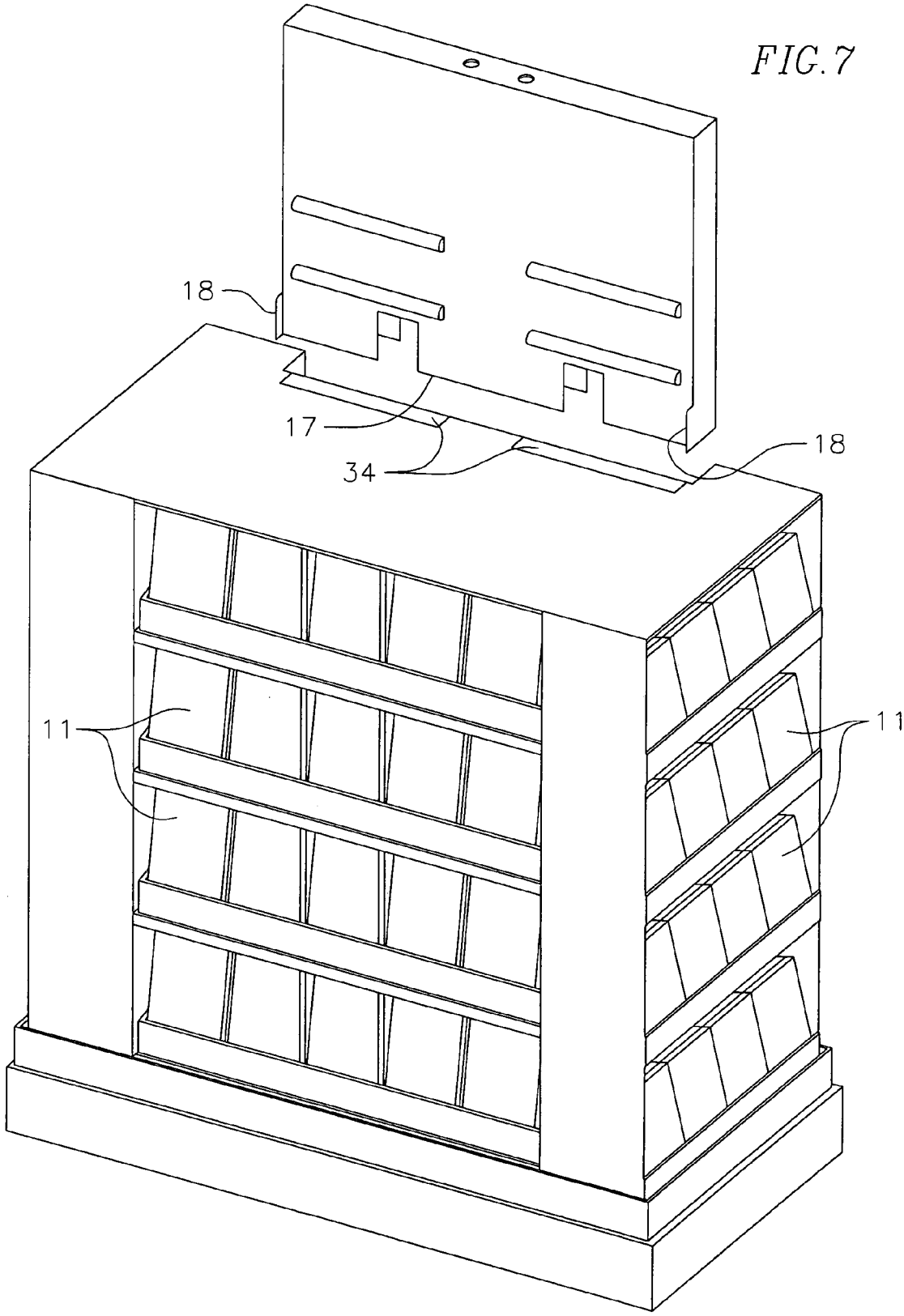
FIG. 7 resembles FIG. 6 and is a front view of the case with the header exploded above the case.

When the header is in its UP or extended position, the long tab 17 extending downwardly from the front of the header, rests on the top of the wings 28 on the central column inside the case. When the header is in is retracted position inside the case, the front of the header holds the wings folded forwardly (not shown) to lie parallel to the inner back panel 21 of the display case. When the lower end of the header passes the ends of the wings, the folded cardboard "springs" 32 and inherent memory of the cardboard cause the wings to move to the extended, converging position illustrated in FIGS. 5 and 6, for example. This puts the wings in position to support the header by way of the descending tab 17. The upper ends of the wings act as a retractable ledge or shelf on which the header rests when extended or elevated.

Figure 1:
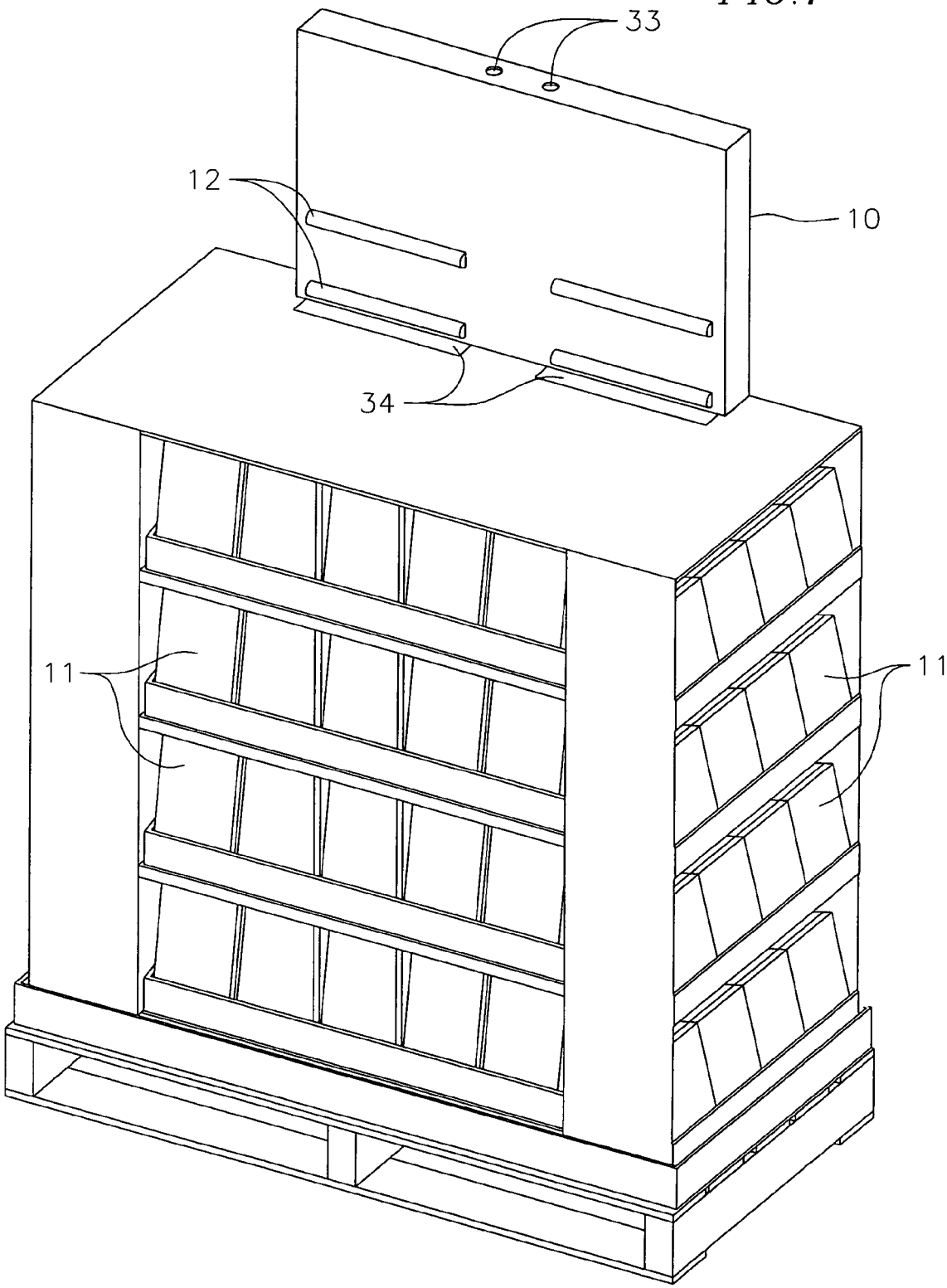
FIG. 1 illustrates an exemplary point of purchase display case with a pop-up display header.
Figure 2:
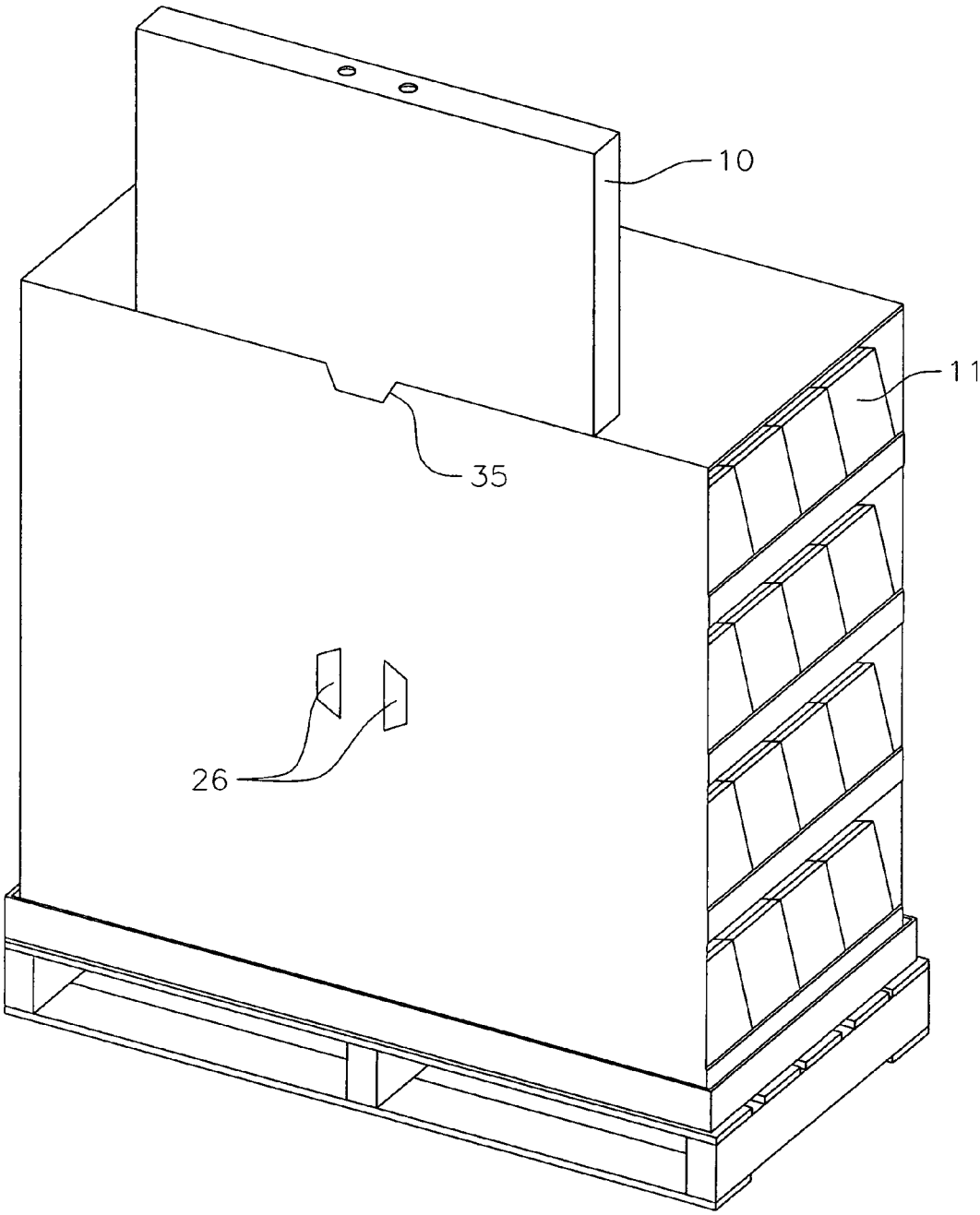
FIG. 2 is a view of the display case from the back with the header elevated, the position that it occupies on the sales floor.

A generally U-shaped slot in the back of the display header defines a central tab 35 which a person setting up the display snaps over the outer back sheet of the display case (FIG. 2) to support the back of the header. In addition, there are two short slots 36 at the opposite ends of the header (near the L-shaped steps) to receive short tabs (not shown) extending laterally into the header from the top of the display case to further hold the header in its extended position. Cardboard is sufficiently flexible or "springy" to pass the side tabs on the top of the case, which than snap into the slots 36 when the header is raised. Likewise, the outer back panel of the case can be flexed and/or the header tilted to snap the back tab over the back of the case. Usually, one simply raises the display header above its rest UP position and reaches through the slot to pull the back tab out over the back panel of the case.

Thus, the header is supported in its upper position by the two tabs in the slots 36 at the ends of the header, by the longer tab 17 at the front face of the header resting on the wings on the column, and at the back face by the tab 35 formed by the slot and fitted over the outer back panel of the display case. Collectively, these support the header so that it does not rock back and forth, or end to end.

If it is desired, the header may be moved downwardly into the display case to take the case off the floor of the store; however, it is usual to simply mash the empty case flat into the recycle bin when its useful life in the store is ended. The header can be moved back down into the case by pulling the outer back panel of the display case away far enough to release the tab 35 over the back and reach inside and push the wings back toward their position parallel to the inner back panel. The header can then be pushed down as the end tabs simply bend out of the way. If desired, an opening can be left in the outer back panel for reaching the wings and folding them out of the way without bending the outer back panel.

The means illustrated for holding the header in its upper position are not the only way of performing this function. For example, the support step for some portion of the bottom of the header can be formed by folding a U-shaped flap around a horizontal axis part way up a central column for supporting the lower end of the header. As another example, foldable flaps or wings can be formed at or near the ends of the pocket in which the header retracts to pop out into the header-supporting position when the header is raised.

A separate roughly trapezoidal piece of cardboard may be folded into a U-shape and hooked into either the outer back panel of the case or the inner flat panel behind the goods displayed. This piece pivots from a retracted position to an extended position supporting the header. This embodiment is similar to the pour spout commonly found on the top of a cylindrical salt container or side of a dishwasher detergent container, for example. Another example of retractable means for supporting the header employs one or more sliding strips of cardboard movable parallel to and along the top of the display case into engagement with slots in the header. Wings may be formed by U-shaped slits in the outer back panel of the case. These can be pushed manually into the space below the header when elevated, to support the bottom edge of the header.

Such retractable shelf or ledge arrangements for supporting the header are on the display case. Alternatively, the means for supporting the header may be integral with or mounted on the header itself. For example, one or more flaps may be formed near the lower end of the header to pivot diagonally outwardly when the header is raised to its extended position. Such flaps rest on the top of the display case and support the header. The flaps may be provided with tabs that snap into slots in the top of the case for retention in the folded-out position. These, in combination with a tab or two like the tab 35 at the back can readily support the header throughout its useful life. One may also use hook and loop fasteners (like Velcro™) for connecting the header and case when the header is in its extended position. Double stick adhesive tape can also be used in a similar manner.

Other arrangements for supporting the header in its upper position, will be apparent to those skilled in the art. "Springs" of metal or rubber may be used, however, it is generally preferred that almost the entire case and its display features be made of cardboard for ready recycling. It is also desirable that whatever means are used should be quite simple and foolproof so that no special skills or tools are required by the sales associates or other store employees who set up the display case in the store. Furthermore, it is desirable that the means for supporting the header be largely inside the case when the header is erected to minimize tampering as well as being more attractive and leaving space on the back of the case for graphics if desired.

A separate column may be deleted from such a display case as described and illustrated, and the header may have a total height about the same as the height of the case. In such an embodiment, the header rests on the bottom of the case (which could be considered the minimum height shelf) when in its retracted position. Any of the previously mentioned means for supporting the header in its raised position may be used. An elongated guide channel may also be included to stabilize the header from tipping.

What is claimed is:

1. A corrugated cardboard display case for receiving goods to be displayed, said display case comprising: a pop-up display header moveable vertically between a lower retracted position within the display case and an upper extended position at least partly outside the display case, the movement of the header being independent of the goods when the goods are being displayed; a fixed shelf inside the display case which fits beneath a portion of the header to support the header in its retracted position; and retractable means inside the display case which fits beneath a portion of the header for supporting the header in its extended position.

2. A display case according to claim 1 wherein the means for supporting the header in its extended position comprises a retractable shelf.

3. A display case according to claim 1 wherein the means for supporting the header comprises a fixed shelf for the lower position and a retractable shelf for the extended position.

4. A display case according to claim 1 wherein the means for supporting the header comprises a cardboard column inside the display case having a shelf at its upper end.

5. A display case according to claim 4 wherein the means for supporting the header comprises a pair of retractable wings above the column forming a shelf at their upper end.

6. A display case according to claim 1 wherein the header is a box-like cardboard body having a front face, a back face, a top face and two side faces spacing the front and back faces apart from each other.

7. A display case according to claim 6 wherein the header further comprises an opening in the top face at least large enough for a person's finger.

8. A display case according to claim 6 wherein the header further comprises a step at a lower end of each side face extending forwardly beyond the front face.

9. A display case according to claim 1 further comprising shelves for accommodating goods for sale on the front and sides of the display case, and wherein the header is at the back of the display case.

10. A display case according to claim 1 comprising means for inhibiting elevation of the header above a predetermined extended position.

11. A cardboard display case for receiving goods to be displayed, said display case comprising:

a box-like case of folded cardboard;

a pop-up display header in the form of a box-like cardboard body extending above the top face of the case;

a hollow inside the case for receiving the header when retracted within the case; and a folding cardboard member within the hollow to support the header in its pop-up position above the display case, wherein said header is moveable between a position retracted within the case and the pop-up position independent of the goods when the goods are being displayed.

12. A cardboard display case according to claim 11 wherein the cardboard member to support the header in its pop-up position comprises a retractable shelf within the case.

13. A cardboard display case according to claim 12 wherein the retractable shelf comprises a folding cardboard member held in a retracted or folded position when the header is retracted within the hollow.

14. A cardboard display case according to claim 11 further comprising a plurality of shelves around at least three faces of the case for displaying goods.

15. A cardboard display case according to claim 14 wherein the header is movable vertically parallel to the back face of the case.

16. A cardboard display case comprising:

a box-like case of folded cardboard having a plurality of shelves for displaying goods;

a pop-up display header near the back face of the case optionally extending above the top face of the case;

a hollow inside the case for receiving the header when retracted within the case; and a folded cardboard member within the case having a shelf engaging the header when extended above the case.

17. A cardboard display case according to claim 16 wherein the folded cardboard member comprises a wing folded out of the way when the header is retracted within the case and folded beneath the header when the header is extended above the top of the case.

18. A cardboard display case according to claim 17 wherein the folded cardboard member is movable between a retracted position when the header is retracted within the case and an extended position when the header is extended above the top of the case.

19. A cardboard display case according to claim 18 further comprising means for supporting the header when it is retracted within the ease.

20. A cardboard display case according to claim 18 comprising a cardboard column inside the display case having a shelf at its upper end.

21. A display case according to claim 20 comprising a pair of retractable wings above the column forming a shelf at their upper end.

22. A display case according to claim 20 wherein the header is a box like cardboard body.

23. A cardboard display case comprising a box-like case of folded cardboard and a display header in the form of a box-like cardboard body extending above the top face of the case, the header comprising a front face, a back face, a bottom and a top face, and two side faces spacing the front and back faces apart from each other, the improvement comprising:

an opening in the top of the case large enough to pass the header;

a hollow inside the case for receiving the header when retracted within the case;

a cardboard shelf within the hollow to support the header when retracted within the hollow with the top face adjacent to the top of the case; and a pair of retractable wings within the hollow to support the header when extended at least partly above the top of the case.

24. In a cardboard display case according to claim 23 a further improvement comprising an opening in the top face of the header for moving the header between a retracted position within the hollow and an extended position at least partly above the top of the case.

25. In a cardboard display case according to claim 23 a further improvement comprising a step at a lower end of each side face.

26. A cardboard display case according to claim 23 wherein the retractable wings are on a column within the hollow.

27. A cardboard display case according to claim 23 wherein the retractable wings are above the cardboard shelf.

28. A cardboard display case according to claim 23 wherein the retractable wings are folded generally parallel to a face of the header when the header is retracted within the hollow and a generally V-shape when the header is extended at least partly above the top of the case.

29. A cardboard display case comprising a retractable cardboard header for a point of purchase product display case, the header comprising:

a box-like cardboard body having a front face, a back face, a bottom, a top face and two side faces spacing the front and back faces apart from each other;

an opening in the top face at least large enough for a person's finger; and a step at a lower end of each side face extending forwardly beyond the front face.

30. A corrugated cardboard display case comprising:

a pop-up display header movable vertically between a lower retracted position within the display case and an upper extended position at least partly outside the display case;

a fixed shelf inside the display case which fits beneath a portion of the header to support the header in its retracted position;

and retractable means inside the display case which fits beneath a portion of the header for supporting the header in its extended position, wherein the means for supporting the header comprises a cardboard column inside the display case having a shelf at its upper end, and wherein the means for supporting the header comprises a pair of retractable wings above the column forming a shelf at their upper end.

31. A corrugated cardboard display case comprising:

a pop-up display header movable vertically between a lower retracted position within the display case and an upper extended position at least partly outside the display case;

a fixed shelf inside the display case which fits beneath a portion of the header to support the header in its retracted position;

and retractable means inside the display case which fits beneath a portion of the header for supporting the header in its extended position, wherein the header is a box-like cardboard body having a front face, a back face, a top face and two side faces spacing the front and back faces apart from each other.

32. A corrugated cardboard display case comprising:

a pop-up display header movable vertically between a lower retracted position within the display case and an upper extended position at least partly outside the display case;

a fixed shelf inside the display case which fits beneath a portion of the header to support the header in its retracted position;

retractable means inside the display case which fits beneath a portion of the header for supporting the header in its extended position; and shelves for accommodating goods for sale on the front and sides of the display case, and wherein the header is at the back of the display case.

33. A corrugated cardboard display case comprising:

a pop-up display header movable vertically between a lower retracted position within the display case and an upper extended position at least partly outside the display case;

a fixed shelf inside the display case which fits beneath a portion of the header to support the header in its retracted position;

retractable means inside the display case which fits beneath a portion of the header for supporting the header in its extended position; and means for inhibiting elevation of the header above a pre-determined extended position.

34. A cardboard display case comprising:

a box-like case of folded cardboard;

a pop-up display header in the form of a box-like cardboard body extending above the top face of the case;

a hollow inside the case for receiving the header when retracted within the case;

a folding cardboard member within the hollow to support the header in its pop-up position above the display case; and a plurality of shelves around at least three faces of the case for displaying goods.

35. A cardboard display case according to claim 34 wherein the header is movable vertically parallel to the back face of the case.

* * * * *